United States Patent [19]

Fröhlich

[11] 4,098,299

[45] Jul. 4, 1978

[54] SLIDE FASTENER

[75] Inventor: Alfons Fröhlich, Essen, Germany

[73] Assignee: OPTI Patent-Forschungs- und Fabrikations-AG, Glarus, Switzerland

[21] Appl. No.: 722,265

[22] Filed: Sep. 10, 1976

[30] Foreign Application Priority Data

Sep. 10, 1975 [DE] Fed. Rep. of Germany ..... 2540272
Sep. 10, 1975 [DE] Fed. Rep. of Germany ..... 2540190

[51] Int. Cl.[2] ..... A44B 19/12

[52] U.S. Cl. ..... 139/384 B; 139/116; 24/205.13 C; 24/205.16 C

[58] Field of Search ..... 139/384 R, 384 B; 24/205.1 R, 205.1 C, 205.13 C, 205.16 C

[56] References Cited

U.S. PATENT DOCUMENTS

| | | | |
|---|---|---|---|
| 3,880,203 | 4/1975 | Frohlich | 139/384 B |
| 3,945,407 | 3/1976 | Jakob | 139/384 B |

FOREIGN PATENT DOCUMENTS

| | | | |
|---|---|---|---|
| 1,022,981 | 1/1958 | Fed. Rep. of Germany | 139/384 B |
| 185,732 | 10/1963 | Sweden | 24/205.13 C |

*Primary Examiner*—Henry S. Jaudon
*Attorney, Agent, or Firm*—Karl F. Ross

[57] ABSTRACT

A slide fastener comprises two continuous plastic filaments (synthetic-resin monofilament), each with a multiplicity of generally helicoidal coupling elements for interlocking with the coupling elements of the opposite filament, each filament being woven integral with the threads of its respective support tape to form a tape-like unit. Each coupling element has a coupling head on a loop end and a pair of shanks terminating in bight portions which connect elements of the same tape-like unit. The shanks of each coupling element, which separate the bights from the loops, are held in close abutment by warp threads, with or without weft threads which pass over and under the successive paired abutting shanks of adjacent elements. Even stronger bracing can be obtained with bulbous projections on the shanks and bights, and by extending the coupling elements the entire width of the tape-like unit, replacing all or part of the weft threads. Thus the shanks can extend transversely to the warp over a substantial part or all of the tape-like unit to form the exclusive weft over this part or the entire width of the tape.

14 Claims, 15 Drawing Figures

L1
L2
X
S
D
F
F'
3
4
5
6
8
9
11
T 1
2
3
5
5a
5b
6
7
8
9
10
12
15
A
P
II
III 1
5
6
11

VI
V
V
12'
12
L2'
L1'
D
S
1
2
3
5
6
7
8
11
13
14

119
103
106
106
5
111
116
116
105g
108
109
105b
105a
105d
105e
105d
105c
105c
105f
101
107
107
120

SLIDE FASTENER

CROSS REFERENCE TO RELATED APPLICATIONS

This application is related to commonly assigned pending applications Ser. No. 122,339, Ser. No. 722,048 and Ser. No. 722,047, all filed Sept. 10, 1976.

Field of the Invention

My present invention relates to a woven slide-fastener unit.

BACKGROUND OF THE INVENTION

Known slide fasteners comprise a multiplicity of coupling elements formed from a pair of plastic filaments in a helix or meander attached to a pair of confronting support tapes, usually by chain stitches or warp threads. A slider interlocks the coupling elements on the confronting edges. Since the tape is made independently of the coupling elements, allowance must be left for sewing on of the filaments. At present, either the tape is made of a continuous pattern of weft and warp threads, or gaps are left in the pattern to be filled in when the element-attaching threads are added.

The resulting fastener has coupling elements with spaced-apart shanks portions, leaving room for the attaching threads or the weft. This arrangement lacks stability, since the properties of the fabric and threads effect the alignment of the coupling elements. Stretching or shrinking can occur due to moisture absorption, applied stress, washing or dry cleaning. The bights which connect the coupling elements cannot stabilize these forces, especially since spiral elements have large portions which are free of attaching threads. All these problems are most significant in the very thin plastic filaments commonly employed in the dress industry.

Present slide fastener manufacturing processes and apparatus can apply relatively few coupling elements to a given number of warp threads. Automatic warp needles avoid this limitation, but are able to produce slide fastener halves, necessitating a multi-stage process.

More specifically, the common helical-coil slide fastener comprises a helix of thermoplastic synthetic-resin monofilament which can form along one side of the helix a multiplicity of coupling elements or heads which are slightly deformed parallel to the axis of the helix so as to interfit or interdigitate with the coupling head of another such coil on the confronting slide fastener half. The coupling head of each turn of the helix is connected by a pair of relatively short shanks to bight portions or bends opposite the coupling head to the shanks of successive turns of the helix. The helix can be somewhat flattened so as to have an elliptical profile as seen along the axis of the helix and the space between each bight and its coupling head is the minimum required to effect coiling of the monofilament.

When such a helix is applied to a woven textile tape, it can receive a filler cord and chain stitching can pass over the shanks and between successive shanks which are spaced apart in accordance with the pitch of the helix to secure the helix to the support tape.

As noted previously it is also possible to "weave" the helix into the support tape directly in which case a loop of at least one and possibly more weft threads passes between each turn of the helix which lies in the manner of a warp within the tape, the coupling heads projecting along an edge of the latter.

There is, therefore, a minimal spacing between each coupling head and the respective bight and a transverse spacing between the successive shanks, even of a single coupling head, which is equal substantially to the pitch of the helix and hence the center-to-center spacing of the coupling heads. Of course, the pitch at any given time is dependent upon the physical parameters of the threads which pass between the shanks, whether these threads are the chain-stitching threads or the weft threads which hold the helix in place. The pitch is not, for the most part, completely stable since the spacing between the coupling elements is determined by the textile material interposed between them as noted immediately above. With shrinkage e.g. resulting from the action of moisture, or stretching (e.g. resulting from the application of stress), by the effective heat and like environmental phenomenon, the textile material between the coupling elements varies in dimension and the interelement spacing can vary along the coil or can vary between the two coils. This can interfere with opening and closing of the slide fastener and furthermore limits the closeness with which the coupling elements can be spaced because the minimum spacing is determined by the textile material interposed between these elements.

OBJECT OF THE INVENTION

It is therefore an object of my present invention to provide an improved slide fastener of the above-described general type.

Another object is to provide a slide fastener of more stable construction which is easy to produce.

SUMMARY OF THE INVENTION

The present invention provides a slide fastener in which the spacing of the coupling elements from one another is no longer dependent upon the type of anchoring system which is used for securing the coil to the supporting structure or tape because of the use of a novel technique whereby the coil is elongated transverse to its longitudinal axis so that the space between each bight and the respective coupling head is a multiple of the spacing previously encountered and indeed can be sufficient to allow the shanks to act at least in part as the exclusive weft over at least a portion of the support structure for the coupling heads.

An important feature of the invention is that each pair of shanks running to a coupling head of the present invention are extended transverse to the warp of the tape-like unit into which the coupling coil is woven so as to receive between each coupling head and the respective bight a plurality of warp threads which pass either over or under this pair of shanks which lie in mutually and directly abutting relationship so that neither the warp threads, with which the shanks are interwoven, nor any additional weft threads which may be applied nor any stitching threads pass between the shanks of each pair.

According to another essential feature of the invention, each coupling element is formed as a loop or eye segment in the region in which it acts as a coupling head and interdigitates with the coupling heads of the opposite coil with the shanks to their junctions with this loop lying in a plane perpendicular to the axis of the coil and to the plane of the slide fastener so that the shanks in these junction regions have coinciding projections upon the slide fastener plane, i.e. cover one another in such projection.

However, directly following these transition or junction regions and running perpendicularly to the warp away from each coupling head, loop or eye, the shanks of each pair are caused to lie in mutually abutting relationship against one another in a plane parallel to the axis of the coil and the plane of the slide fastener.

Thus each pair of shanks, lying in such mutually abutting relationship acts as a double-filament weft interwoven with the warp threads over the width of the tape-like unit along which the coil extends. Of course, where the length of the shanks is substantially equal to the width of the tape, no additional weft is required and the paired shanks function as the sole weft for the tapes. On the other hand, where the tape-like unit is formed integrally with an edge of the tape, extending over a span of a multiplicity of warp threads, an additional weft can be provided for the balance of the tape, the additional weft being looped about the bights of the turns of the coil.

I have used the term "coil" herein in its most general sense and it will be apparent that the same principle applies to true helices in which the coupling elements are formed by continuous turns or to meanders. The warp threads pass over and under the paired abutting shanks to form therewith a particularly firm support structure. However, the shanks can form the weft also of a weft-inlay warp-knit fabric, each pair of shanks lying in a respective course of the knit.

More specifically, these objects are attained according to my present invention in a slide fastener in which a pair of continuous flexible synthetic-resin monofilaments are formed with a multiplicity of coupling elements interconnectable along confronting edges by movement of a slider thereon. Each coupling element has a loop end with a coupling head, a pair of shanks extending from the loop end, and a bight portion connecting the shanks of adjacent elements. The shanks of each element are held in side-by-side relationship over the greater portion of their length by textile warp threads passing between adjacent elements, with the warp threads and the coupling elements being woven in an integral tape-like unit.

Such a slide fastener, having coupling elements generally transverse to the warp with shanks in side-by-side (abutting) relationship over the greater portion of their length and in vertically-superposed relationship for a lesser portion of its length, is self-bracing and therefore more stable in the face of external forces than those known in the art. Strength can even be increased by adding bosses on the bight portions and on the shanks.

A slide fastener assembled from such tape-like units is not only simpler to produce and stronger in operation, but also presents a lower profile than the present helix-shaped coupling elements.

According to another feature of the invention, the slide fastener is provided with textile weft threads over all or part of the width of the tape-like unit, permitting a true textile tape to extend beyond the bights of the coupling elements. The weft threads can also brace the coupling elements by wrapping around the shank, neck or bight portions of the element in overloops. Most advantageously the ratio of overall length to shank diameter for the coupling element can vary between substantially 5:1 and 20:1, the shorter length applying to those with additional weft arrangements and having a preferred value of 8:9, the longer applying to those wherein the coupling elements replace separate weft threads completely and extend to and define the lateral boundaries of the tape-like units, having a preferred value of 13:1.

The slide fastener of the present invention can be a so-called "strip" fastener in which the usual support tape is not used so that the "strip" formed with the paired shanks as weft and warp threads extending the full length of the strip, can be stitched by conventional sewing techniques to a garment directly, or in which the coupling elements can be inserted into a garment. Alternatively, the slide fastener can be of conventional tape type. In the first case, the bights lie along one edge of the tape-like support structure or strip and can form guide plates for the slider which can extend over the full width of the strip and another strip which can be joined to the first movement of the slider along the coils to interconnect the coupling elements. In the second case, the tape can be stitched to the garment or to the support.

The advantage of the present system resides in the fact that the spacing of the coupling elements from one another is not effected by the characteristics of the anchoring structure. The entire coupling element strip is dimensionally determinate and stable because the shanks which connect the coupling elements directly abut one another and because the shanks are held in pairs by the warp without intervening of textile filament or threads between the shanks of the pairs. The paired shanks lie in pockets within the warp and are not susceptible to distortion which otherwise might affect the filaments. Changes in thickness of the warp have no effect on the pockets and even longitudinal stresses which could result in stretching of the warp do not change the relative positions of the pockets.

The positions of the bights are similarly stabilized and, in accordance with a feature of the invention, it is possible to make the shanks of different lengths so that bights are formed alternately at a relatively greater and lesser spacing from the coupling heads.

Furthermore, the formation of the shank pairs and their incorporation in respective pockets of the warp makes production of the slide fastener substantially simpler, especially when it is carried out on mechanical weaving looms or knitting machines since the soupling coil can be formed by needles the same as those used for the inlaying of double weft with the addition of a loop-forming mandrel to produce the coupling elements, eyes or heads. Thus the present invention also involves a special weaving process and an associated apparatus.

According to this aspect of the invention, two synthetic-resin monofilament threads are woven in the warp shed as weft threads by a needle which pass into the warp shed from opposite sides thereof and lie as respective filaments around a common mandrel before leaving the shed. The warp is reshedded and the weft formed by inlayed monofilament is beaten up by the batten or reed so that the two weft passes through each warp pocket of the filament lie in mutually abutting relationship as a double weft.

The synthetic-resin monofilament can then be subjected to thermofixing, preferably at the mandrel.

As is known in connection with the fabrication of slide fasteners with synthetic-resin monofilaments, thermofixing is a heat treatment in which the applied shape of the coupling element and coil is stabilized, i.e., any resilient stress is relaxed.

The method can be carried out in a conventional tape-forming loom with the addition of the weft inlaying needles and a centrally disposed mandrel about which the coupling heads are formed. The mandrel may be carried by a raisable and lowerable mandrel holder operated in the cadence of operation of the weft needles to accommodate the inward and outward passes thereof.

BRIEF DESCRIPTION OF THE DRAWING

The above and other features will now be described in detail with reference to the accompanying drawing in which.

SPECIFIC DESCRIPTION

Figure 2:
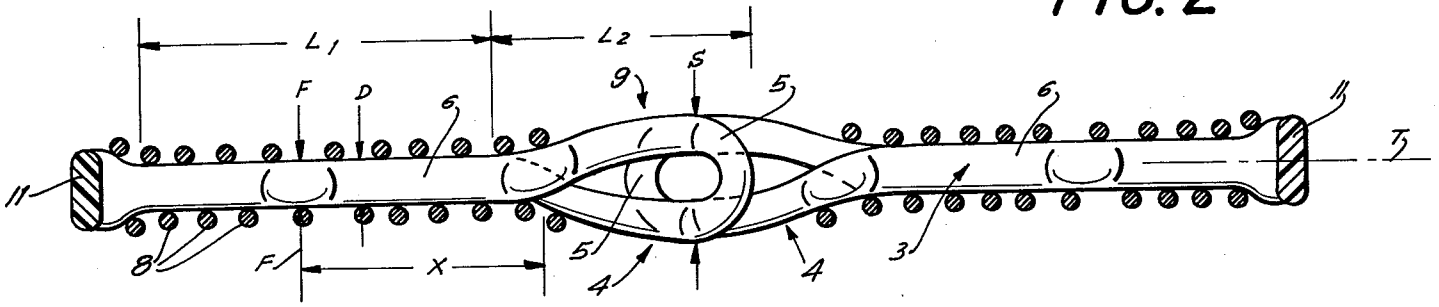
FIG. 2 is a cross-sectional view of the device of FIG. 1 taken along line II—II.
Figure 1:
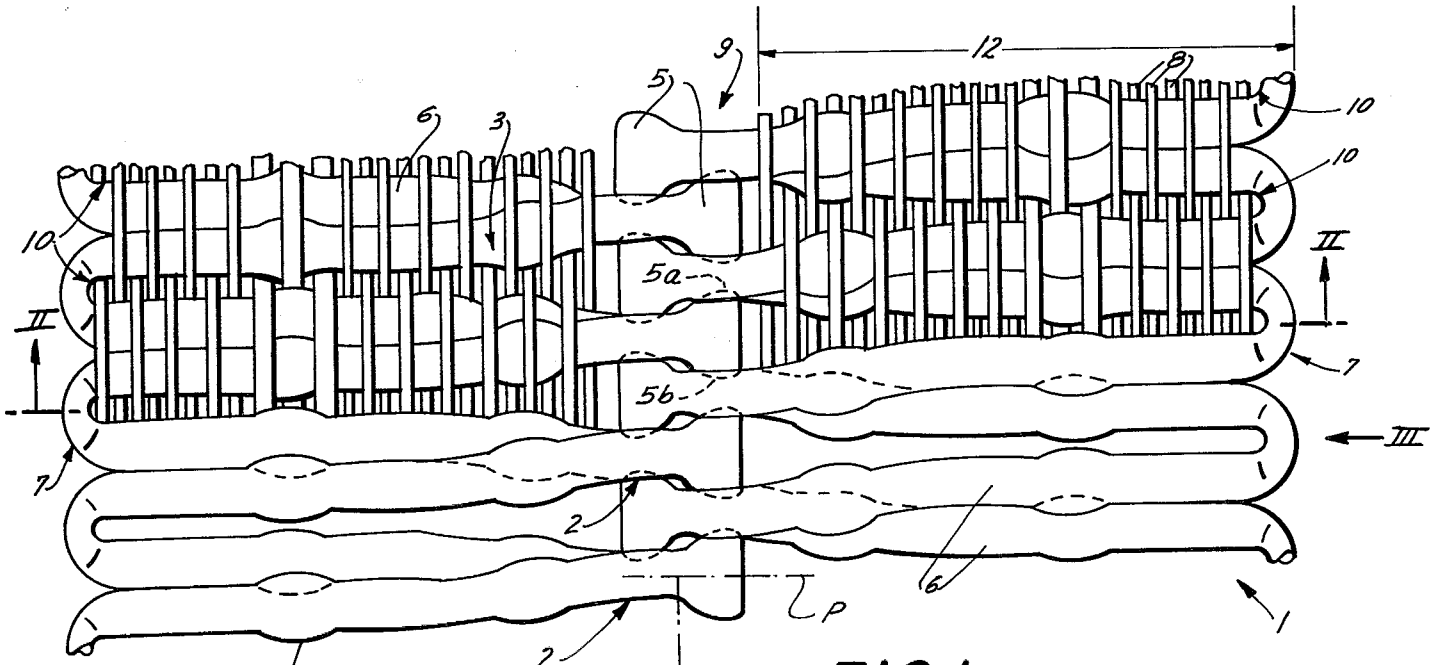
FIG. 1 is a diagrammatic plan view of a slide fastener according to my present invention.
Figure 3:
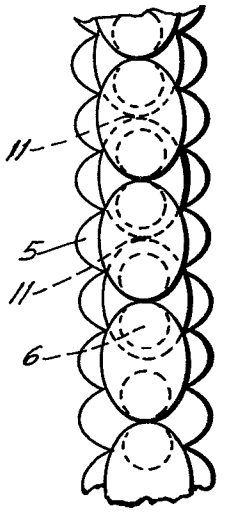
FIG. 3 is a side view of the device of FIG. 1 taken in the direction of arrow III.

As seen in FIGS. 1, 2 and 3, a strip-type tapeless slide fastener has a pair of interdigitated synthetic-resin monofilament coils 1 (e.g. of polyester or nylon). Each coil 1 has a multiplicity of coupling elements 3, each comprising a loop end 4 with locking necks 2 and a locking head 5, a pair of shanks 6 lying in side-by-side relationship over the greater portion of their length, and a reversely bent bight portion 7 which connects adjacent elements 3.

Coupling elements 3 on opposite sides of a contact zone 9 are interlocked by their heads 5 and necks 2. Textile warp threads 8 form warp pockets 10 receiving the paired shanks 6 of adjacent elements 3, forming with the elements 3 a single tape-like unit 12 with the shanks 6 in side-by-side pairs replacing the usual weft threads. Edge bosses 11 on the bights 7 serve to define the spacing between the pockets 10 and to guide a slider (not shown), while shank bosses 15 aid bracing of the tape-like unit 12.

From FIGS. 1 - 3 it will also be apparent that the bosses 15 are formed laterally on the synthetic-resin monofilament strand 15 at distances X corresponding to half the loop lengths of the heads 5 so that, when these heads are formed around a mandrel, the bosses produce lateral projections 5*a* and 5*b* of the head which are received in the neck or transition portions 2 of the loops. The bosses may be formed, prior to inlaying of monofilaments in the warp sheds by plastically deforming the monofilament with a force as represented by the arrows F in FIG. 2.

In one preferred embodiment of the invention, the length $L_2$ of the head loop 5 is smaller than the shank length $L_1$, i.e., $L_1$ is greater than $L_2$ and this can be found to be the case in all of the embodiments of the invention disclosed herein. The head loop 5 lies in a plane P perpendicular to the axis A of the heads and hence to the longitudinal axis of the coil formed by each monofilament. In FIG. 1, the plane of the paper can be considered to be the plane of the slide fastener and the plane P is perpendicular to the plane of the paper and to the slide fastener.

The length $L_1$ is a considerable multiple of the diameter D of the monofilament, preferably being between five and twenty times this diameter D. The system illustrated in FIGS. 1 - 3, moreover, has the monofilament extending the full width of the strip formed by the paired shanks 6 as the exclusive weft and the warp threads 8. A considerable number of warp threads extend over and under the pairs of shanks between the bights 7 and the heads 5 and in all cases a multiplicity of such warp threads will overlie and underlie the paired shanks. At least five such warp threads should extend along the weft formed by the shanks. The bosses 15 in the region of the bights result in plate-like formation 11 at the latter to form ridges along which the slider (not shown) is guided. Over the major part of their length, i.e., at least over the region $L_1$, the shanks 6 lie in a plane T perpendicular to the plane of the paper in FIG. 2 and corresponding to the plane of the slide fastener mentioned earlier. The plane T is of course perpendicular to the plane P.

In the region 9 at which the coupling heads 5 interdigitate, the junctions 2 between the shanks 6 and the arcuate segment of each coupling head 5 lie one above the other so that their respective projections upon the plane T coincide. Away from the coupling heads 5, the shanks 6 lie directly side-by-side in mutually abutting relationship in pairs within the common warp pockets 10. These considerations also apply to the embodiments of FIGS. 4 - 6 as well.

Figures 4, 5, 6:
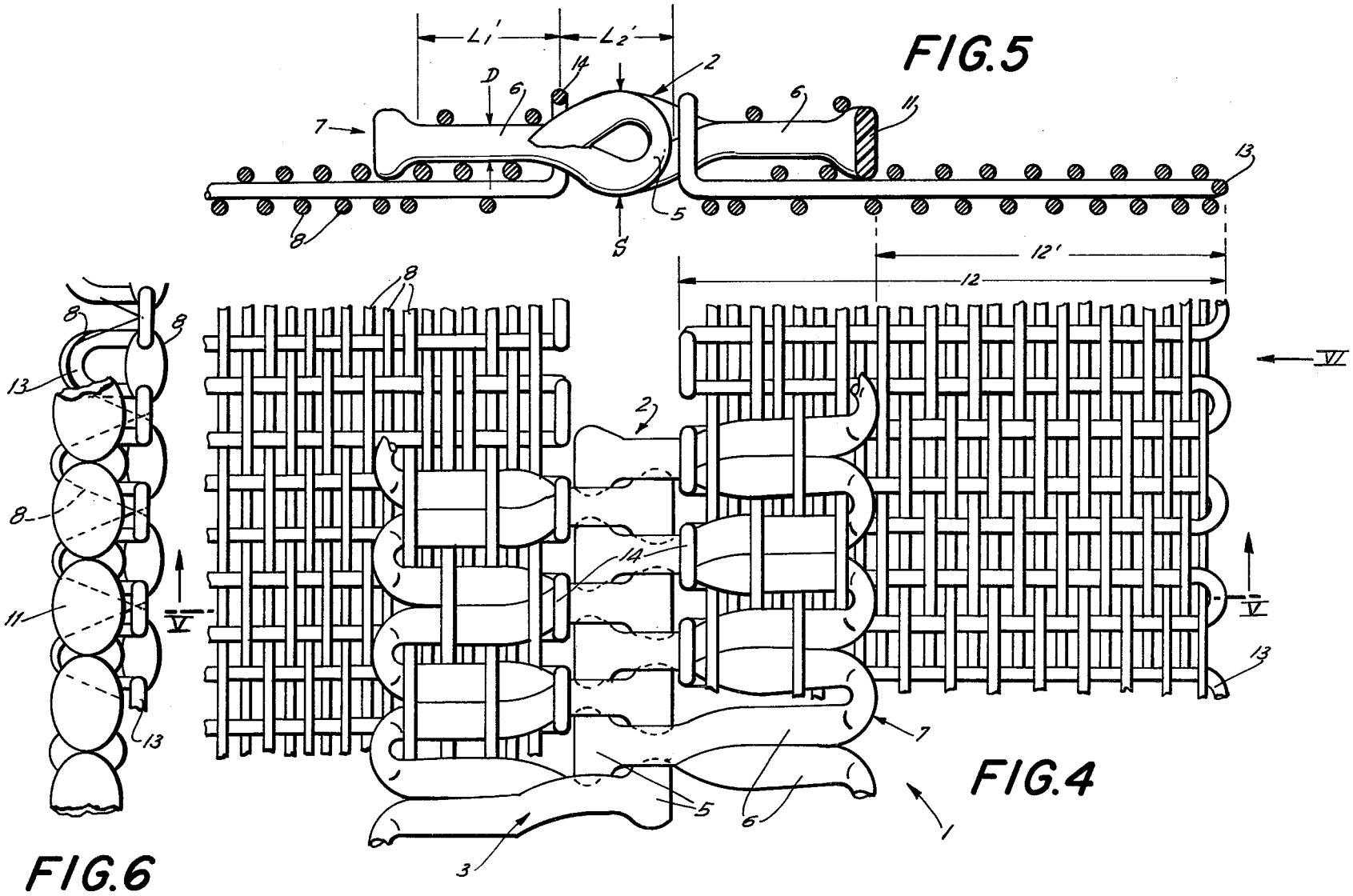
FIG. 4 is a diagrammatic plan view of another embodiment of my invention.
FIG. 5 is a cross-sectional view of the device of FIG. 4 taken along line V—V.
FIG. 6 is a side view of the device of FIG. 4 in the direction of arrow VI.

FIGS. 4, 5 and 6 show a tape-like unit 12 having a textile tape portion 12' with the weft fibers 13 as well as the warp fibers 8. The weft fibers 13 wrap around each coupling element 3 between the locking necks 2 and the shanks 6 in an overloop 14.

Figure 7:
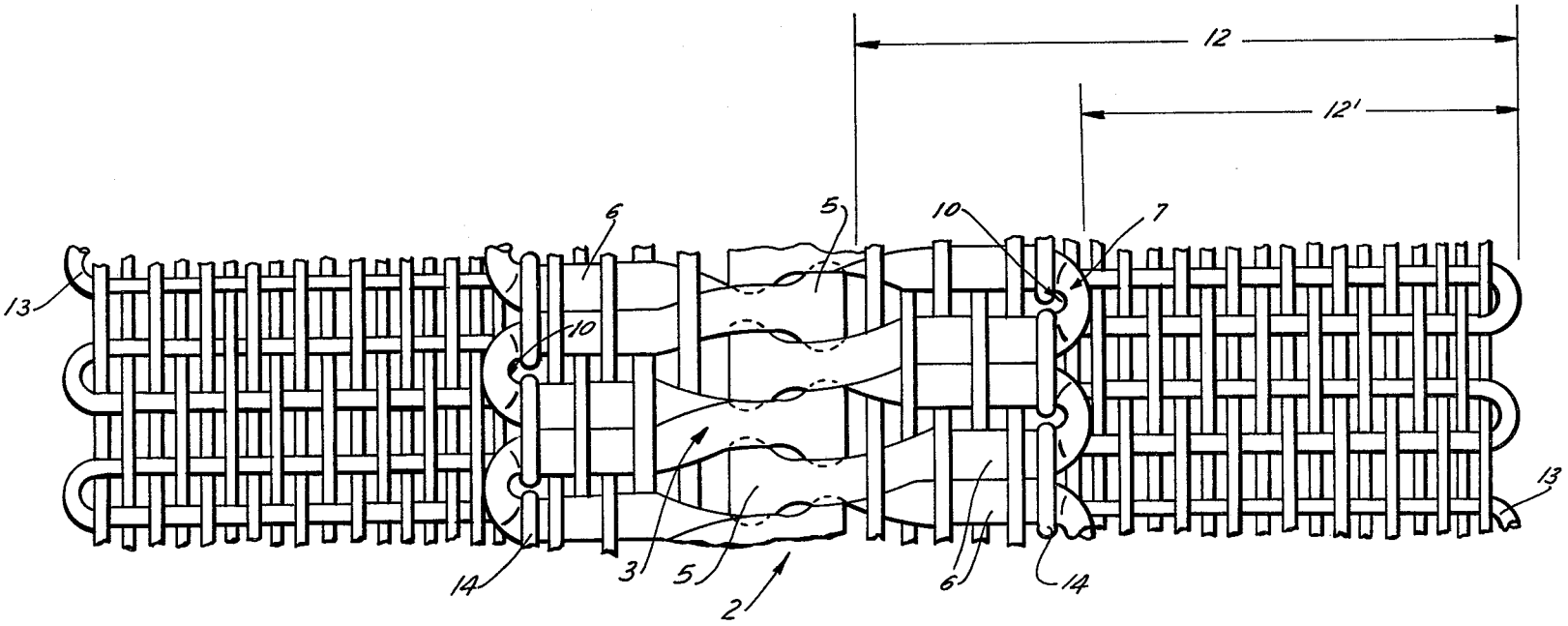
FIG. 7 is a diagrammatic plan view of still another embodiment of the invention.

FIG. 7 shows a tape-like unit 12 having a textile tape portion 12' with weft fibers 13 which wrap around the shanks 6 of the coupling elements 3 at the bights 7 in an overloop 14.

In the embodiments of FIGS. 1 - 7, the reversing bends or bights 7 form stabilizers for the spacing of the coupling heads and movement of the paired shanks 6 relative to one another is precluded. Since no textile threads lie between the shanks 6 of each pair, the interhead spacing is not affected by factors which have effected the stretching threads or weft filaments hitherto used by the successive shanks in conventional coupling elements.

Upon shrinkage of the longitudinal or warp threads 8 or thermal fixing of the slide fastener, the paired shanks 6 in the respective warp pockets 10 are uniformly stressed and variation in the interhead spacing does not occur.

While the longitudinal threads 8 are preferably constituted as the web threads of a weave and cross over and under alternately the successive pairs of shanks 6, it will be understood that the longitudinal threads can also represent the loop forming threads of a warp knit fabric in which the paired shanks are inlaid as a double knit weft.

The strips shown in FIGS. 1 - 3 and constituting respective slide fastener halves directly, without separate tapes, can be affixed by stitching directly to garment parts or the like, the stitching being effected across the paired shanks 6 with the needle passing between them.

In the embodiment of FIGS. 4 through 7, the strip structure forms part of a tape which has a region 12 consisting exclusively of textile threads so that this portion 12' can be secured by stitching to the parts of the garment or the like.

In the embodiment of FIGS. 4 through 6 the shanks 6 are somewhat shorter although their lengths $L_1$ still exceed the lengths $L_2'$ of the heads 5. Advantageously the head diameter S is the most equal to $L_2'$. The relationship between the length $L_1'$ and the diameter D can correspond to that originally described. In the embodiments of FIGS. 4 through 7, of course, the bights 7 may form guide plates 11 for the slider as previously described.

Figure 8:
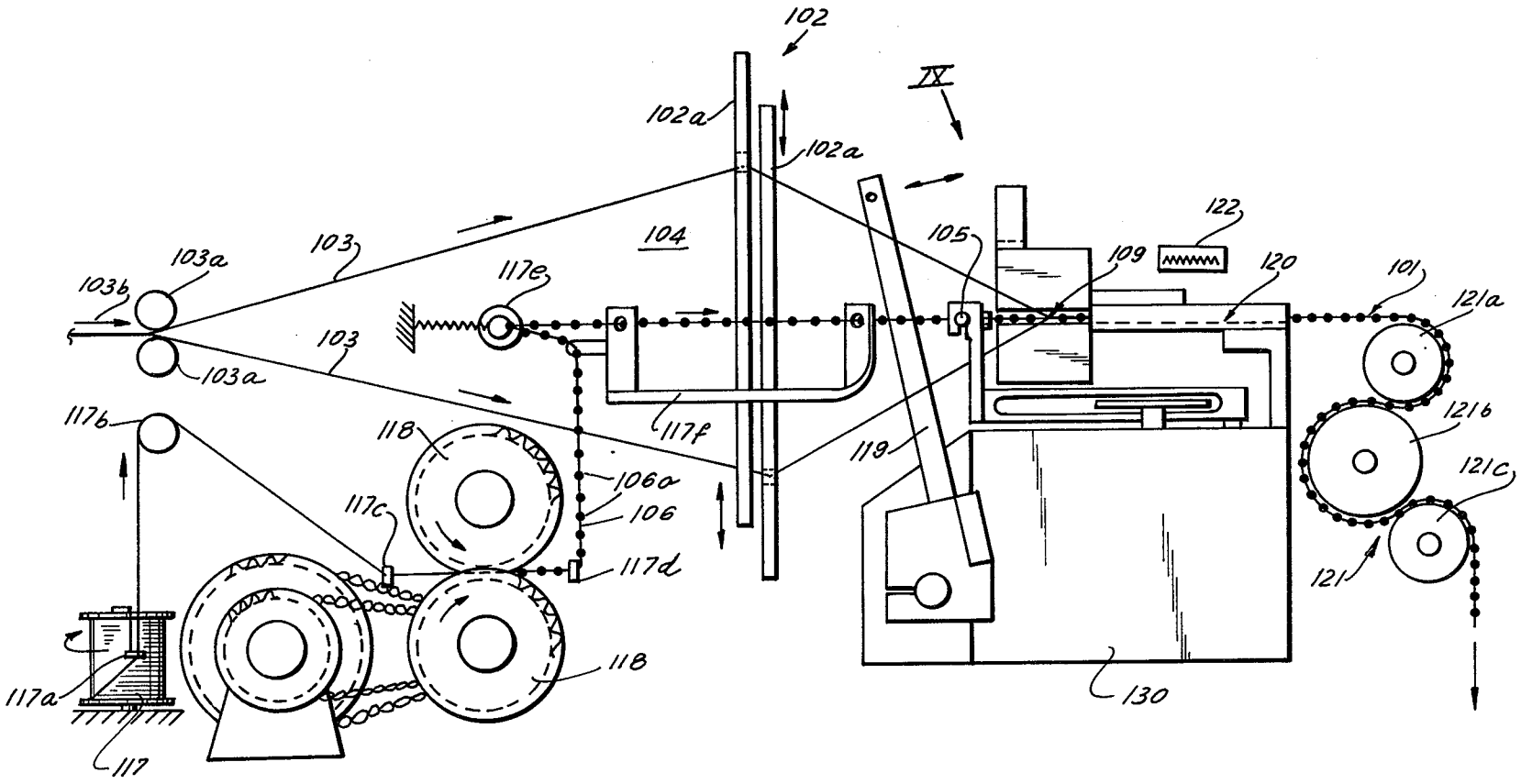
FIG. 8 is a diagrammatic side view of a slide-fastener-making apparatus according to my present invention.
Figure 9:
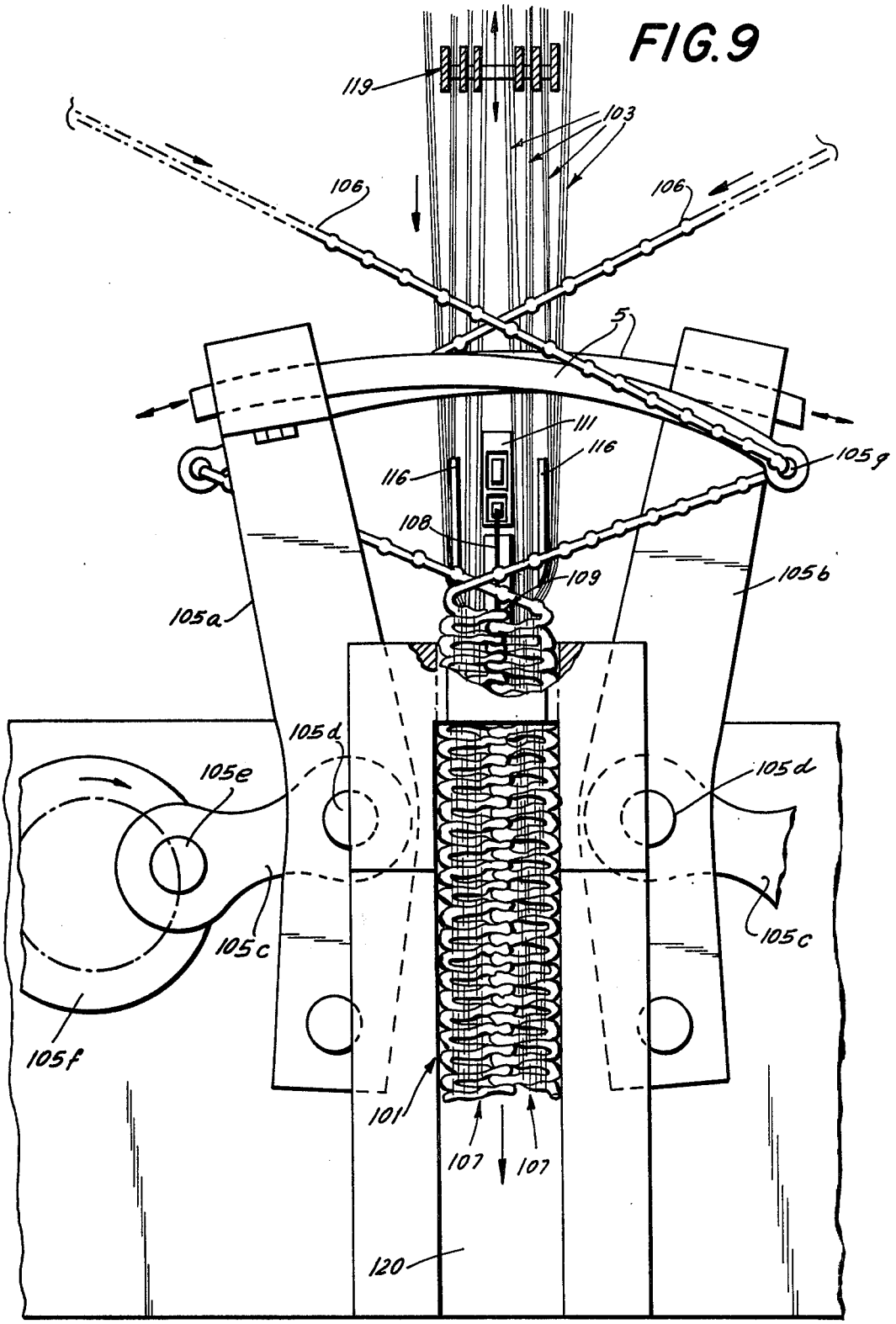
FIG. 9 is a plan view of a segment of FIG. 8 in the direction of arrow IX.

FIGS. 8, 9 illustrate the basic elements of the apparatus for fabricating the interdigitating strip slide fastener structures shown in FIGS. 1 through 3 and represented, in FIGS. 8 and 9, at 101.

The apparatus comprises a warp-feed beam (not shown) from which the warp threads 103 are passed between a pair of rollers **103*a* in the direction of arrow 103*b*, the warp threads traversing respective heddles 102*a* of a harness 102 capable of forming a warp shed 104. As will be apparent from FIG. 9**, the warp threads are divided into two groups and have a space between them.

From each side of the loom, respective weft-inlaying needles 105 carry the respective synthetic-resin monofilaments 106 into and through the respective sheds. To this end, the needles 105 are carried by arms **105*a* and 105*b* driven by links 105*c* which are articulated to the arms 105*a*, 105*b* at pivots 105*d*. Each link is swingable on an eccentric pin 105*e* driven by a wheel 105*f* so that the needles are swung alternately to the right and to the left through respective sheds. The needles are synchronized with the heddle control (not shown) which can be of the usual tape-weavint type, and with the batten or reed 119 which is swingable, as can be seen in FIG. 8, to beat up the weft as it is led into the shed. Guides 116 engage the filaments to form the bights remote from the heads and prevent the weft inlaying from pulling the warp 103** inwardly.

As is also apparent from FIG. 8, the monofilament 106 is drawn from a spool 117 through a traveling eye **117*a* and passes over a guide roller 117*b* and between a pair of eyes 117*c* and 117*d* between a pair of embossing rollers 118 which can be heated ultrasonically or otherwise to form the bosses 106*a* (corresponding to the bosses 15 of FIGS. 1 through 3), therein. The embossed monofilament is then passed through a spring loaded eye 117*e* and a guide 117*f* to the eyelets 105*g* of the respective weft-inlay needle. The loom housing 130 is formed with a channel 120 through which the interlocked coupling elements are guided on to a takeoff unit 121 comprising a plurality of rollers 121*a*, 121*b* and 121*c* which frictionally engage the strip and reversely bend it to facilitate variation of the strip. A thermofixing device in the form of a heater as represented at 122 above the guide 120 can be provided and, as will become apparent hereinafter, the bending mandrel 108** can also be extended into a heated portion which effects thermofixing of the heads.

The flexible mandrel 108 is disposed centrally between the weft sheds 104 for the respective slide fastener halves and, at the end 110 of the mandrel turned away from the downstream end 109 of the weft shed, is mounted in a raisable and lowerable mandrel holder 111 slidably.

As can be seen from FIG. 9, the weft-inlaying needles 105 lie in horizontal planes disposed one above the other so that their filament-entraining ends can cross over in the shed 104.

The mandrel holder 111 is received in a centrally interrupted vertical guide 112 and can be shifted by a plunger arrangement 113 between its upper and lower positions in which it is retained by magnets 114.

Figures 11, 11A, 11B:
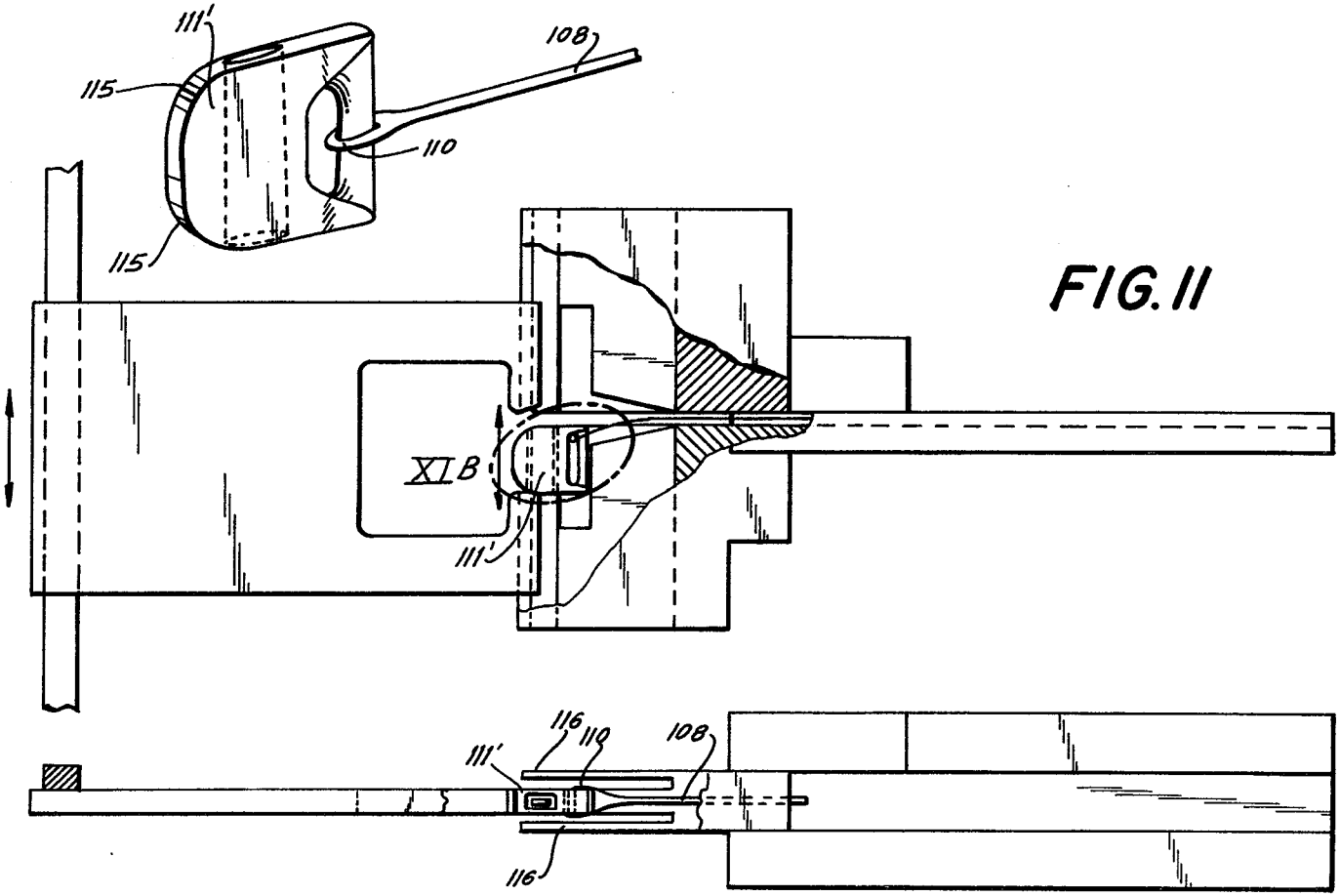
FIG. 11 is a diagrammatic side view, partly cut away, of another embodiment of the device of FIG. 10.
FIG. 11A is a plan view of the device of FIG. 11.
FIG. 11B is an isometric view of the area XIB of FIG. 11.

Of course, this holding arrangement 114 can be eliminated and the device can be constituted, as shown in FIG. 11, with rounded corners 115 of the mandrel holder 111' so that it is cammed (FIGS. 11 and **11*a***) into its upper and lower positions.

The device illustrated in FIGS. 8 through 10 operates as follows:

Two supply spools 117 feed respective synthetic-resin monofilaments 106 through respecrive embossing roller pairs 118 to the respective weft needles. As can be seen from FIG. 9, the weft needles 105 lay the monofilament 106 into the warp shed across the lower set of warp threads and pass the mandrel 111. The mandrel 111 thereupon drops and the needles 105 withdraw the filament again across the lower threads of the shed. The harness actuated to reverse the shed and the weft is beaten up by the reed 119. Each shed, therefore, forms a pocket for a pair of mutually contacting shanks of the coupling elements. The process is repeated with the new shed and as many times as necessary to produce the desired length of slide fastener.

The length of the mandrel 108 is so selected that the coupling heads withdraw therefrom only after a considerable number of coupling heads are interdigitated by the needles. The mandrel can remain in place within the coupling heads until thermofixing has relaxed the stresses of the monofilament. Advantageously, the warp filaments are shrinkable and are subjected to a thermal shrinking operation to reduce their length by 10 to 15% to ensure a particularly tight grip of the shanks in the warp pockets.

The system has been described for the fabrication of a substantially coiled coupling element in which the coupling heads are generally wound around the mandrel. However, it was possible to provide the coupling elements 107 as U-shaped meander structure in which case the inlaying needles 105 are displayed directing the respective weft inlays so that one monofilament is brought over the other and vice versa in successive operations.

Figure 10:
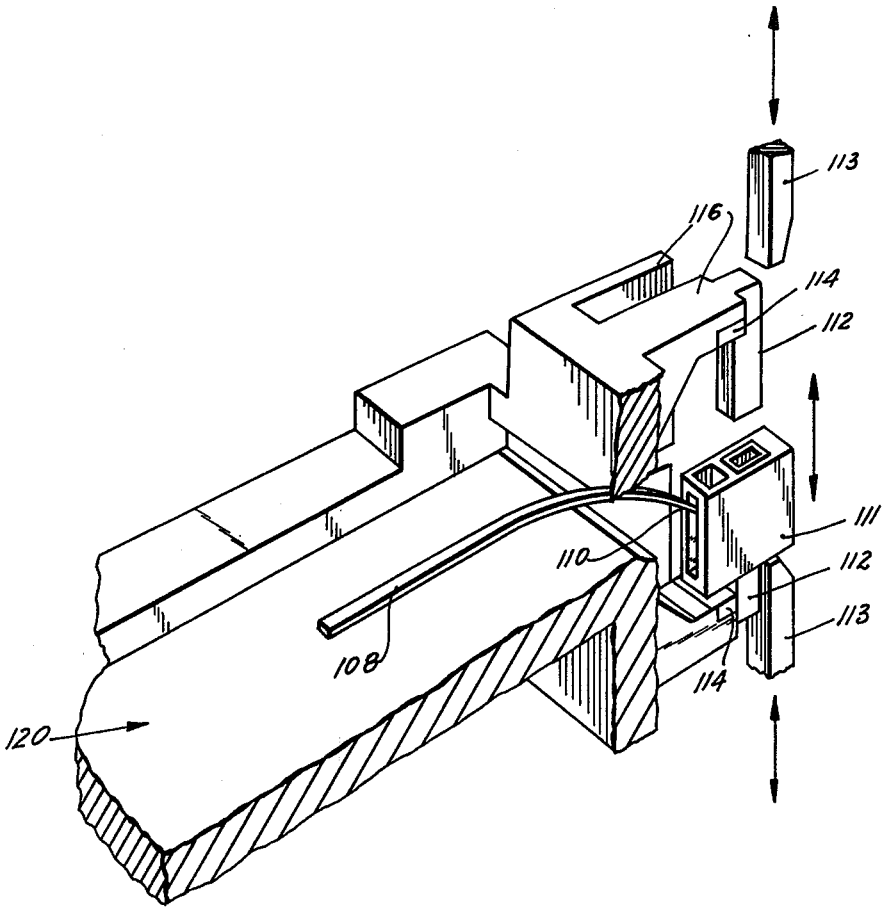
FIG. 10 is an isometric view of the apparatus of FIG. 9 partly cut away.
Figure 12:
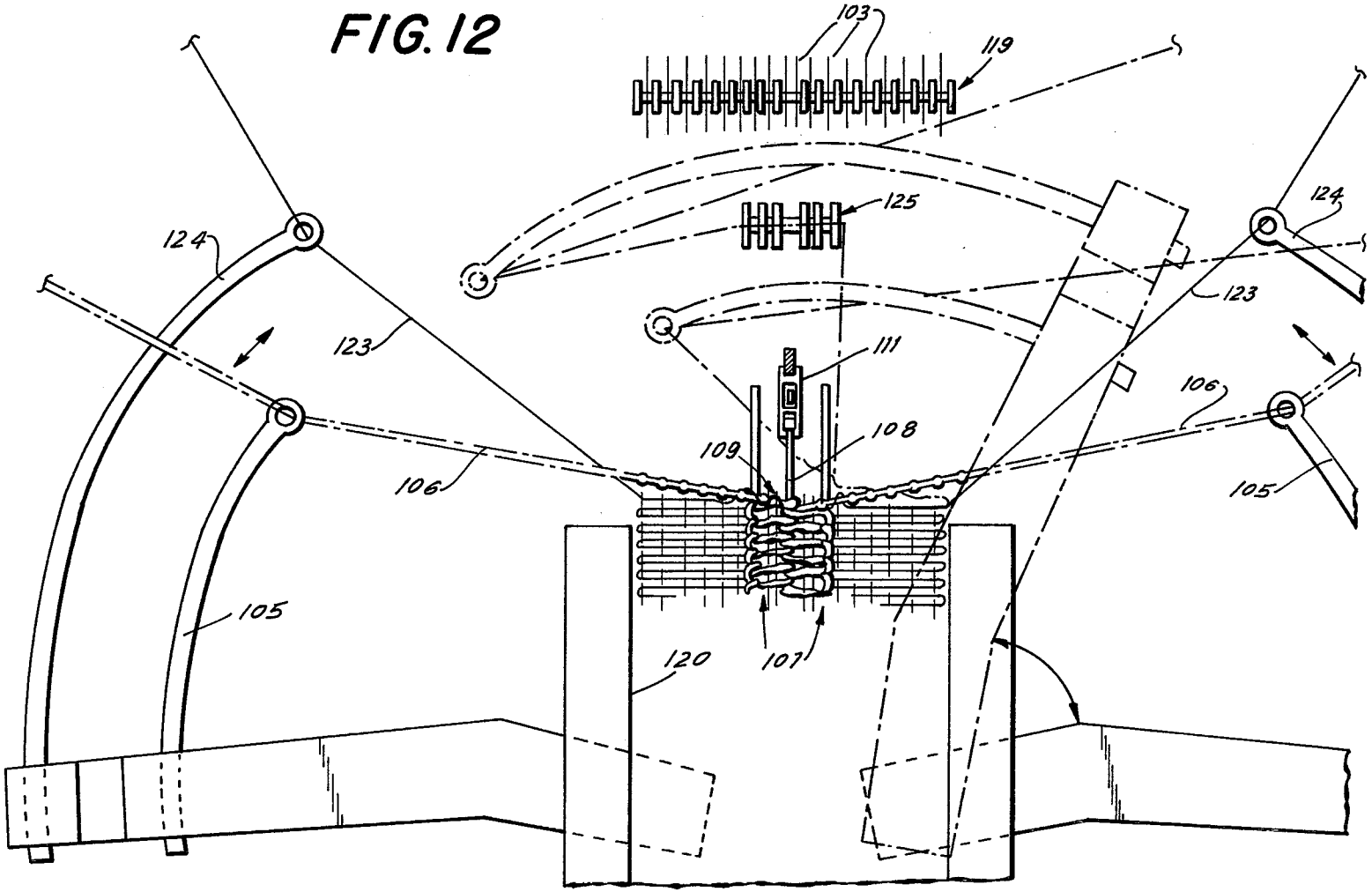
FIG. 12 is a diagrammatic plan view of a variation of the device of FIG. 9.
Figure 13:
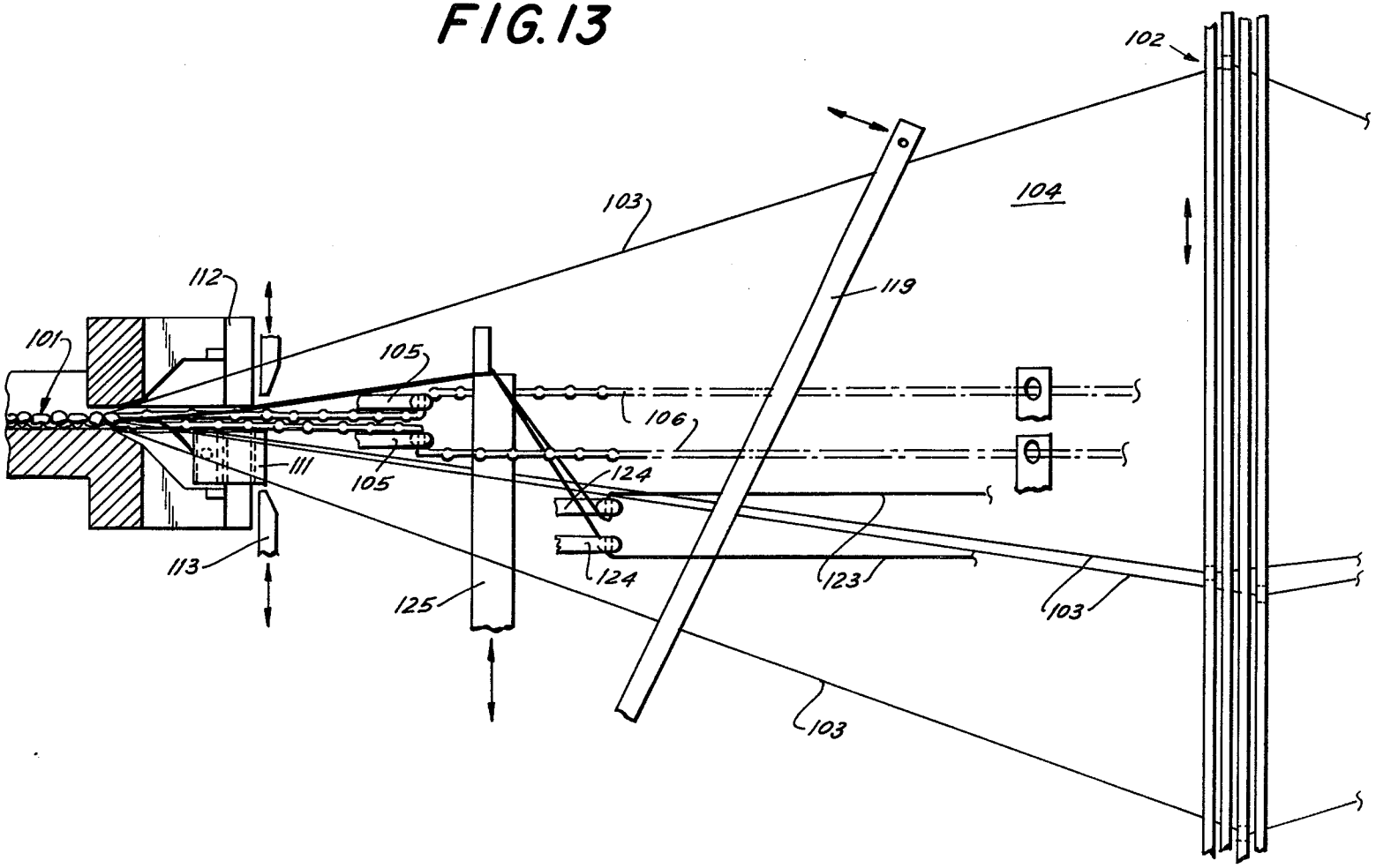
FIG. 13 is a diagrammatic side view of the apparatus of FIG. 12.

The system illustrated in FIGS. 12 and 13 differs from that of FIGS. 8 through 10 only in that the weft needles carry, in addition to the weft needle 105 for the monofilament, designed to coil the latter over only part of the width of the web (see FIG. 7), needles 124 which carry the additional weft threads 123 across the region 12' of the tape to hook into the bights of the filament before they reach the mandrel 108. A weft thread lifter 125 is here provided to insure proper engagement of each bend of the monofilament with the textile thread weft. The remaining structure of course is the same as thet of FIGS. 8 through 10 and a similar mode of operation prevails.

I claim:

1. In a slide fastener comprising two rows of interdigitatable coupling elements formed by respective synthetic-resin monofilaments, wherein each coupling element of each row has an eye-shaped coupling head adapted to be received between the heads of the other row, a pair of connecting shanks extending away from the coupling head, and respective bights joining each shank to a shank of the next coupling element, and wherein each row of coupling elements is held by longitudinal textile threads in a tape-like support structure with the coupling heads projecting laterally along an edge of the support structure, the improvement wherein:

each coupling head lies in a plane substantially perpendicular to the plane of the tape-like support structure;

the shanks of each coupling element lie in a plane parallel to the slide-fastener plane beyond transition regions at which the shanks join the respective coupling head;

the shanks of each coupling element extending away from said transition regions laterally and directly abut one another in the plane of the abutting shanks which is parallel to the slide-fastener plane;

the longitudinal textile threads form transverse pockets each receiving a respective one of said pairs of shanks; and the respective bights extend out of each pocket into adjacent ones of said pockets.

2. The improvement defined in claim 1 wherein the longitudinal textile threads are warp threads of a weave which cross between successive shank pairs, the shanks forming at least part of the weft of said weave.

3. The improvement defined in claim 1 wherein said tape-like structure is formed along the edge of a support tape having additional weft and warp threads, said longitudinal textile threads forming part of the warp of the tape.

4. In a slide fastener comprising two rows of interdigitatable coupling elements formed by respective synthetic-resin monofilaments, wherein each coupling element of each row has an eye-shaped coupling head adapted to be received between the heads of the other row, a pair of connecting shanks extending away from the coupling head, and respective bights joining each shank to a shank of the next coupling element, and wherein each row of coupling elements is held by longitudinal textile threads in a tape-like support structure with the coupling heads projecting laterally along an edge of the support structure, the improvement wherein:

the shanks of each coupling element join the respective eye-shaped coupling head at transition regions which have coincident projections in the slide fastener plane;

the shanks of each coupling element extending away from said transition regions form a respective pair of abutting shanks lying in a plane parallel to the slide fastener plane;

the longitudinal textile threads form transverse pockets each receiving a respective one of said pairs of shanks; and the respective bights extend out of each pocket into adjacent ones of said pockets, said tape-like structure being formed along the edge of a support tape having additional weft and warp threads, said longitudinal textile threads forming part of the warp of the tape, said tape being further provided with a textile weft thread looping over the eye-shaped coupling heads of a respective row.

5. The improvement defined in claim 4 wherein said bights form guide ridges along edges of the slide fastener and are adapted to guide a slider therealong.

6. The improvement defined in claim 4 wherein said tape is formed with a textile weft thread looped around the bights of the respective coupling elements.

7. The improvement defined in claim 4 wherein said longitudinal threads are shrunk against the shanks.

8. The improvement defined in claim 4 wherein said shanks are provided with cross-sectional deformations to reduce the bending stiffness thereof.

9. The improvement defined in claim 8 wherein said deformations constitute flattenings lying generally parallel to the slide fastener plane.

10. In a slide-fastener stringer the improvement which comprises:

a pair of elongated continuous flexible synthetic-resin filaments formed with a multiplicity of coupling elements and interconnectable along confronting edges upon movements of a slider therealong, each coupling element comprising a loop end with a coupling head on its confronting edge, a pair of directly laterally abutting straight shanks extending from said loop end, and a bight portion connecting the shanks of adjacent elements remote from the confronting edges;

warp threads passing between adjacent elements to hold the shanks of each said elements in close abutment as shank pairs, said warp threads and said coupling elements being woven integrally as a single tape-like unit with said shanks constituting at least part of the weft of said unit, said coupling elements lying generally transversely to said warp threads, each of said pairs of shanks lying in a side-by-side relationship over the greater portion of their length and being in top-to-bottom relationship over a lesser portion of their length adjacent the respective head, the ratio of the lengths of said shanks from said bight portions to said coupling heads to the diameter of the filament being between substantially 5:1 and 20:1.

11. In a slide-fastener stringer the improvement which comprises:

a pair of elongated continuous flexible synthetic-resin filaments formed with a multiplicity of coupling elements and interconnectable along confronting edges upon movement of a slider therealong, each coupling element comprising a loop end with a coupling head on its confronting edge, a pair of directly laterally abutting straight shanks extending from said loop end, and a bight portion connecting the shanks of adjacent elements remote from the confronting edges;

warp threads passing between adjacent elements to hold the shanks of each said elements in close abutment as shank pairs, said warp threads and said coupling elements being woven integrally as a single tape-like unit with said shanks constituting at least part of the weft of said unit; and a weft thread of textile fibers substantially parallel to said shanks and interwoven with said warp threads, said warp threads and said weft threads interweaving to form a tape portion integral with but extending laterally beyond said tape-like unit at said bight portions, said weft thread passing in overloops about said coupling elements between respective bight portions and said coupling heads.

12. The improvement defined in claim 11 wherein said coupling elements lie generally transversely to said warp threads.

13. The improvement defined in claim 11 wherein each of said pairs of shanks lie in a side-by-aide relationship over the greater portion of their length and are in top-to-bottom relationship over a lesser portion of their length adjacent the respective head.

14. The improvement defined in claim 11 wherein said bight portions have respective forces forming lateral boundaries of said tape-like unit.

* * * * *